US012434803B2

(12) United States Patent
Saruwatari et al.

(10) Patent No.: US 12,434,803 B2
(45) Date of Patent: Oct. 7, 2025

(54) OUTBOARD MOTOR

(71) Applicant: YAMAHA HATSUDOKI KABUSHIKI KAISHA, Iwata (JP)

(72) Inventors: Kimitaka Saruwatari, Shizuoka (JP); Tomohiro Hagi, Shizuoka (JP); Yu Wakamizu, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 446 days.

(21) Appl. No.: 18/134,597

(22) Filed: Apr. 14, 2023

(65) Prior Publication Data

US 2024/0101239 A1 Mar. 28, 2024

(30) Foreign Application Priority Data

Sep. 22, 2022 (JP) ..... 2022-151616

(51) Int. Cl.
*B63H 20/12* (2006.01)
*B63H 20/14* (2006.01)
*B63H 20/32* (2006.01)

(52) U.S. Cl.
CPC ..... *B63H 20/12* (2013.01); *B63H 20/14* (2013.01); *B63H 20/32* (2013.01)

(58) Field of Classification Search
CPC ..... B63H 20/08; B63H 20/12; B63H 20/14; B63H 20/32
USPC ..... 440/76, 53
See application file for complete search history.

(56) References Cited

U.S. PATENT DOCUMENTS 462,572 A * 11/1891 Mueller ..... B63H 20/10 440/59
3,654,889 A * 4/1972 Bergstedt ..... B63H 20/002 440/61 R
3,688,733 A * 9/1972 Blanchard ..... B63H 20/12 248/642
3,946,698 A * 3/1976 LaFollette ..... B63H 20/12 440/61 R
4,041,889 A * 8/1977 Blanchard ..... B63H 25/12 114/144 R
4,618,327 A * 10/1986 Kitai ..... B63H 20/12 440/60
4,887,982 A * 12/1989 Newman ..... B63H 5/10 416/128
7,666,039 B2 * 2/2010 Zelm ..... B63H 20/12 440/60
10,800,502 B1 * 10/2020 Alby ..... B63H 20/28
11,130,554 B1 * 9/2021 Alby ..... B63H 20/245
(Continued)

*Primary Examiner* — Joshua E Freeman
(74) *Attorney, Agent, or Firm* — Keating & Bennett, LLP

(57) ABSTRACT

An outboard motor includes a first housing, a second housing, a propeller shaft, and a steering mechanism. The steering mechanism includes a first pinion gear, a second pinion gear, a first rack, and a second rack. The first pinion gear is connected to the first housing or the second housing. The second pinion gear is connected to the first pinion gear. The first rack includes first teeth. The first teeth mesh with the first pinion gear and are arranged side by side with each other in a first direction. The first rack is movable in the first direction. The second rack includes second teeth. The second teeth mesh with the second pinion gear and are arranged side by side with each other in a second direction. The second teeth have a smaller module than the plurality of first teeth. The second rack is movable in the second direction.

9 Claims, 9 Drawing Sheets

(56) References Cited

U.S. PATENT DOCUMENTS

| | | | | |
|---|---|---|---|---|
| 11,866,133 | B1 * | 1/2024 | Mueller | B63B 79/10 |
| 12,304,607 | B1 * | 5/2025 | Alby | B63H 20/245 |
| 12,365,435 | B2 * | 7/2025 | Saruwatari | B63H 25/02 |
| 2008/0113571 | A1 * | 5/2008 | Zelm | B63H 20/12 440/60 |
| 2010/0167604 | A1 * | 7/2010 | Inaba | B63H 20/12 440/60 |
| 2012/0094559 | A1 * | 4/2012 | Takase | B63H 20/06 440/61 S |
| 2019/0047673 | A1 * | 2/2019 | Yasui | B63H 20/12 |
| 2021/0129964 | A1 * | 5/2021 | Miyashita | B63H 20/06 |
| 2024/0067317 | A1 * | 2/2024 | Weber | F16H 19/04 |
| 2024/0308635 | A1 * | 9/2024 | Bredda | B63H 20/12 |

* cited by examiner

OUTBOARD MOTOR

CROSS REFERENCE TO RELATED APPLICATIONS

This application claims the benefit of priority to Japanese Patent Application No. 2022-151616 filed on Sep. 22, 2022. The entire contents of this application are hereby incorporated herein by reference.

BACKGROUND OF THE INVENTION

1. Field of the Invention

The present invention relates to an outboard motor.

2. Description of the Related Art

Some outboard motors are equipped with a steering mechanism that turns a housing around a steering axis. For example, the outboard motor of U.S. Pat. No. 10,800,502 includes a lower gear case and a steering mechanism for steering the lower gear case. The steering mechanism steers the lower gear case with a rack and pinion. Specifically, the steering mechanism includes a piston, a steering column, and a steering actuator. The piston includes a plurality of teeth. The steering column is connected to the lower gear case and includes a plurality of teeth. The plurality of teeth of the steering column mesh with the plurality of teeth of the piston. The steering actuator linearly moves the piston. As a result, the steering column rotates and the lower gear case is steered.

SUMMARY OF THE INVENTION

In the rack-and-pinion steering mechanism as described above, the steering angle of the housing increases according to a movement distance of the rack. Therefore, in order to obtain a large steering angle, the movement distance of the rack becomes large, and the size of the outboard motor becomes large. Preferred embodiments of the present invention provide outboard motors that are each able to obtain a large steering angle while reducing or preventing an increase in sizes of the outboard motors.

An outboard motor according to a preferred embodiment of the present invention includes a first housing, a second housing, a propeller shaft, and a steering mechanism. The second housing is supported by the first housing and steerable around a steering axis. The propeller shaft is in the second housing and extends in a front-rear direction of the outboard motor. The steering mechanism steers the second housing around the steering axis. The steering mechanism includes a first pinion gear, a second pinion gear, a first rack, and a second rack. The first pinion gear is connected to the first housing or the second housing. The second pinion gear is connected to the first pinion gear. The first rack includes a plurality of first teeth. The plurality of first teeth mesh with the first pinion gear and are arranged side by side with each other in a first direction. The first rack is movable in the first direction. The second rack includes a plurality of second teeth. The plurality of second teeth mesh with the second pinion gear and are arranged side by side with each other in a second direction. The plurality of second teeth have a smaller module than the plurality of first teeth. The second rack is movable in the second direction.

According to the above-described preferred embodiment, the first rack is movable in the first direction while the first teeth mesh with the first pinion gear so that the first pinion gear rotates and the second housing is steered. Further, the second rack is movable in the second direction while the second teeth mesh with the second pinion gear so that the second pinion gear rotates and the second housing is steered. The second teeth have a smaller module than the first teeth. Therefore, the size of the second rack is reduced. As a result, a large steering angle is obtained while reducing or preventing an increase in the size of the outboard motor.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
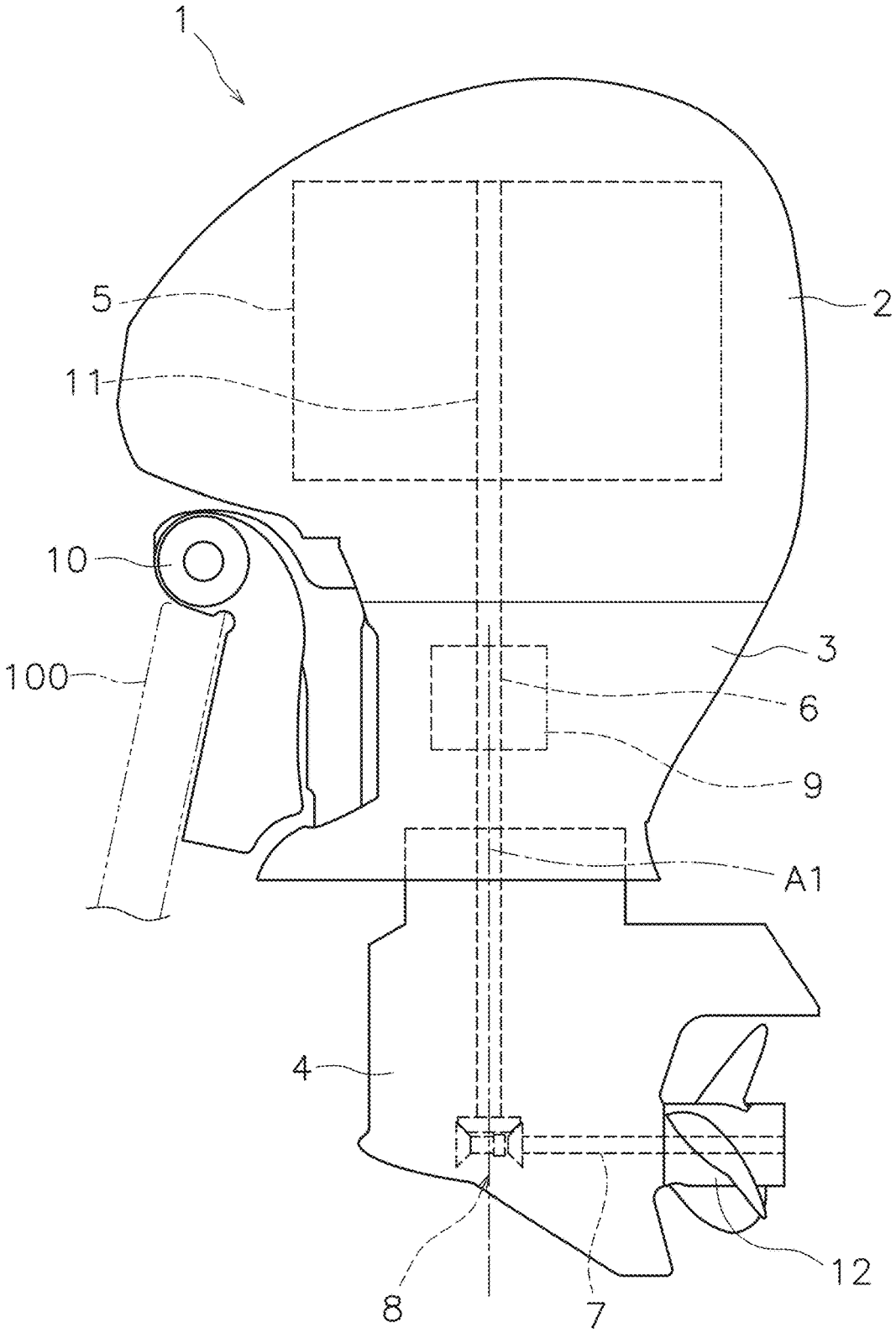
FIG. 1 is a side view of an outboard motor according to a preferred embodiment of the present invention.

Preferred embodiments of the present invention will be described below with reference to the drawings. FIG. 1 is a side view of an outboard motor 1 according to a preferred embodiment of the present invention. The outboard motor 1 is attached to a stem of a boat 100 via a bracket 10. The outboard motor 1 generates thrust to propel the boat 100. The outboard motor 1 includes a cowl 2, a first housing 3, a second housing 4, a drive source 5, a drive shaft 6, a propeller shaft 7, a shift mechanism 8, and a steering mechanism 9.

The drive source 5 generates thrust that propels the boat 100. The drive source 5 is, for example, an internal combustion engine. Alternatively, the drive source 5 may include an electric motor. The drive source 5 is arranged in the cowl 2. The first housing 3 is arranged below the cowl 2. The second housing 4 is arranged below the first housing 3. The second housing 4 is supported by the first housing 3 so as to be steerable about a steering axis A1.

The drive source 5 includes a crankshaft 11. The crankshaft 11 extends in the vertical direction of the outboard motor 1. The drive shaft 6 is connected to the crankshaft 11. The drive shaft 6 extends in the vertical direction of the outboard motor 1. The drive shaft 6 is arranged in the first housing 3 and the second housing 4. The propeller shaft 7 extends in the front-rear direction of the outboard motor 1. The propeller shaft 7 is arranged in the second housing 4. The propeller shaft 7 is connected to the drive shaft 6 via the shift mechanism 8. A propeller 12 is attached to the propeller shaft 7. The shift mechanism 8 switches the transmission direction of rotation from the drive shaft 6 to the propeller shaft 7 between the forward direction and the reverse direction. The shift mechanism 8 includes gears and clutches, for example.

Figure 2:
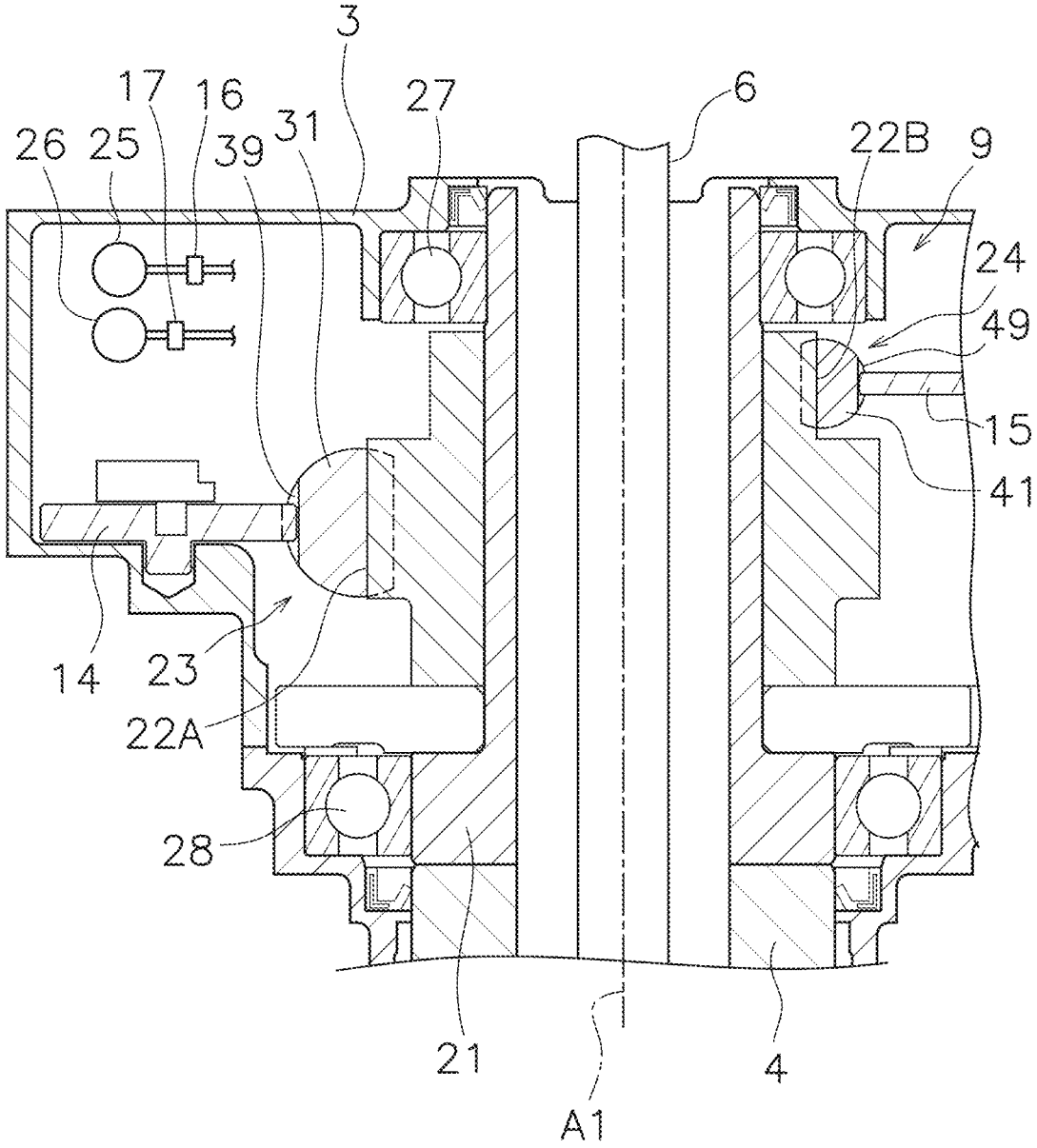
FIG. 2 is a cross-sectional view of a portion of the outboard motor.
Figure 3:
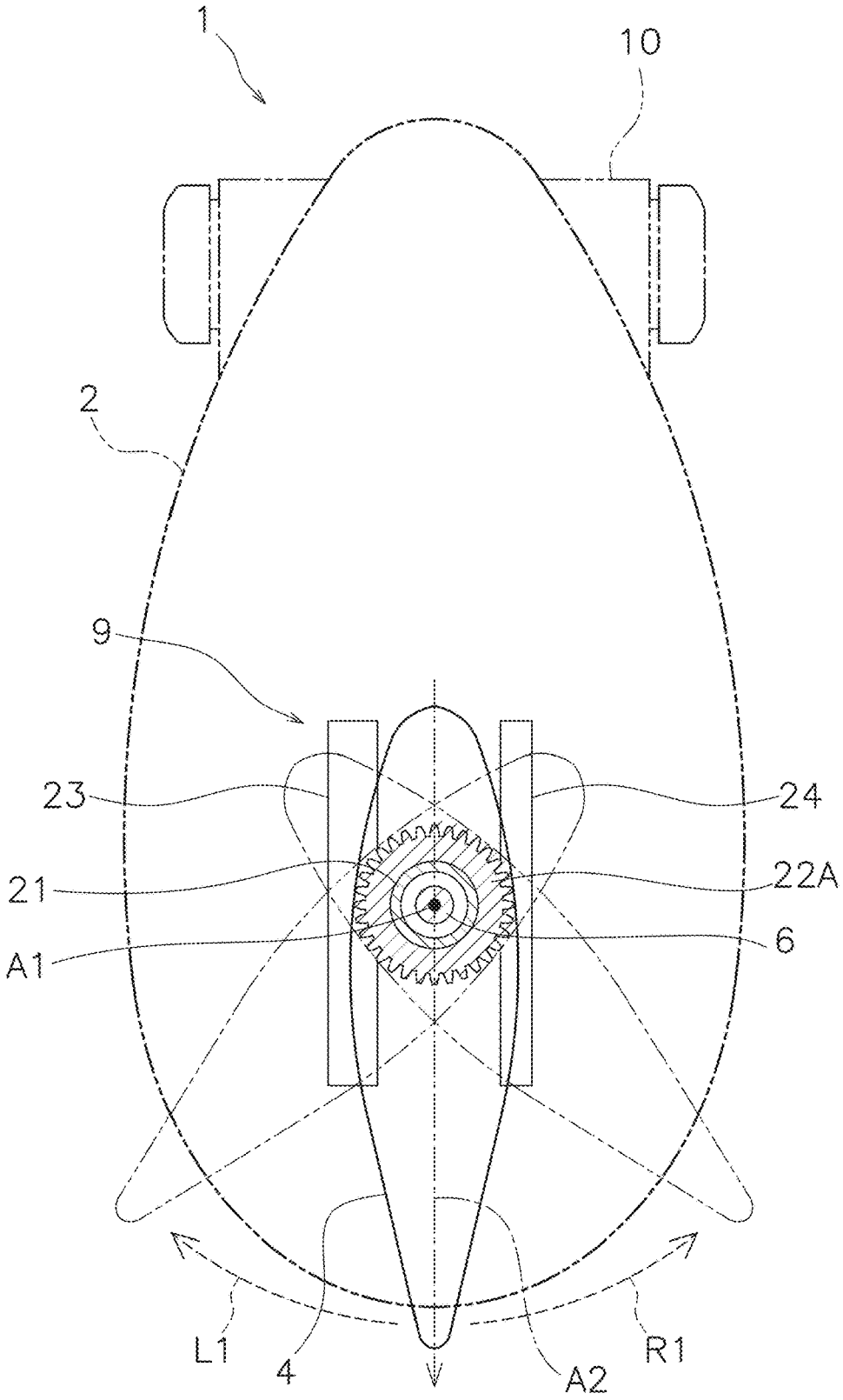
FIG. 3 is a top view of the outboard motor.

FIG. 2 is a side sectional view showing a portion of the outboard motor 1. FIG. 3 is a top view of the outboard motor 1. FIGS. 4 to 8 are schematic top views showing the operation of the steering mechanism 9. As shown in FIG. 3, the steering mechanism 9 rotates the second housing 4 about the steering axis A1 with respect to the first housing 3 in accordance with the operation of a steering operation member such as a steering wheel or a joystick. The steering axis A1 extends in the vertical direction of the outboard motor 1. The steering axis A1 is concentric with the drive shaft 6.

As shown in FIG. 2, the steering mechanism 9 includes a steering shaft 21, a first pinion gear 22A, a second pinion gear 22B, a first cylinder 23, a second cylinder 24, a first hydraulic actuator 25, and a second hydraulic actuator 26. The steering shaft 21 is arranged in the first housing 3. The steering shaft 21 extends in the vertical direction of the outboard motor 1. The steering shaft 21 is concentric with the drive shaft 6. The steering shaft 21 has a hollow tubular shape. The drive shaft 6 extends through the steering shaft 21. The steering shaft 21 is rotatable with respect to the drive shaft 6. The steering shaft 21 is rotatably supported with respect to the first housing 3 via bearings 27 and 28. The steering shaft 21 is fixed to the second housing 4.

The first pinion gear 22A is fixed to the steering shaft 21. The first pinion gear 22A is non-rotatable with respect to the steering shaft 21. The second pinion gear 22B is arranged vertically side by side with the first pinion gear 22A. The second pinion gear 22B has a smaller module than the first pinion gear 22A. The second pinion gear 22B has a smaller outer diameter than the first pinion gear 22A. The second pinion gear 22B is connected to the first pinion gear 22A. The second pinion gear 22B rotates together with the first pinion gear 22A.

The steering shaft 21 rotates together with the first pinion gear 22A and the second pinion gear 22B. The first pinion gear 22A and the second pinion gear 22B are connected to the second housing 4 via the steering shaft 21. Therefore, the second housing 4 rotates around the steering axis A1 in accordance with the rotation of the first pinion gear 22A and the second pinion gear 22B.

The first cylinder 23 and the second cylinder 24 are hydraulic cylinders. The first cylinder 23 faces the first pinion gear 22A. The first cylinder 23 rotates the first pinion gear 22A. The second cylinder 24 faces the second pinion gear 22B. The second cylinder 24 rotates the second pinion gear 22B. The first cylinder 23 and the second cylinder 24 extend in the front-rear direction of the outboard motor 1. The first cylinder 23 and the second cylinder 24 are spaced apart from each other in the left-right direction of the outboard motor 1.

The first hydraulic actuator 25 is a hydraulic pump. The first hydraulic actuator 25 supplies hydraulic fluid to the first cylinder 23 by being driven by an electric motor. The electric motor may be driven by electricity generated by the drive source 5. Alternatively, the first hydraulic actuator 25 may be driven by the drive source 5. The first hydraulic actuator 25 is connected to a first control valve 16. The first control valve 16 controls the flow of hydraulic fluid from the first hydraulic actuator 25. The first cylinder 23 is driven by hydraulic fluid from the first hydraulic actuator 25 to rotate the first pinion gear 22A.

The second hydraulic actuator 26 is a hydraulic pump. The second hydraulic actuator 26 supplies hydraulic fluid to the second cylinder 24 by being driven by an electric motor. The electric motor may be driven by electricity generated by the drive source 5. Alternatively, the second hydraulic actuator 26 may be driven by the drive source 5. The second hydraulic actuator 26 is connected to a second control valve 17. The second control valve 17 controls the flow of hydraulic fluid from the second hydraulic actuator 26. The second cylinder 24 is driven by hydraulic fluid from the second hydraulic actuator 26 to rotate the second pinion gear 22B.

Figure 4:
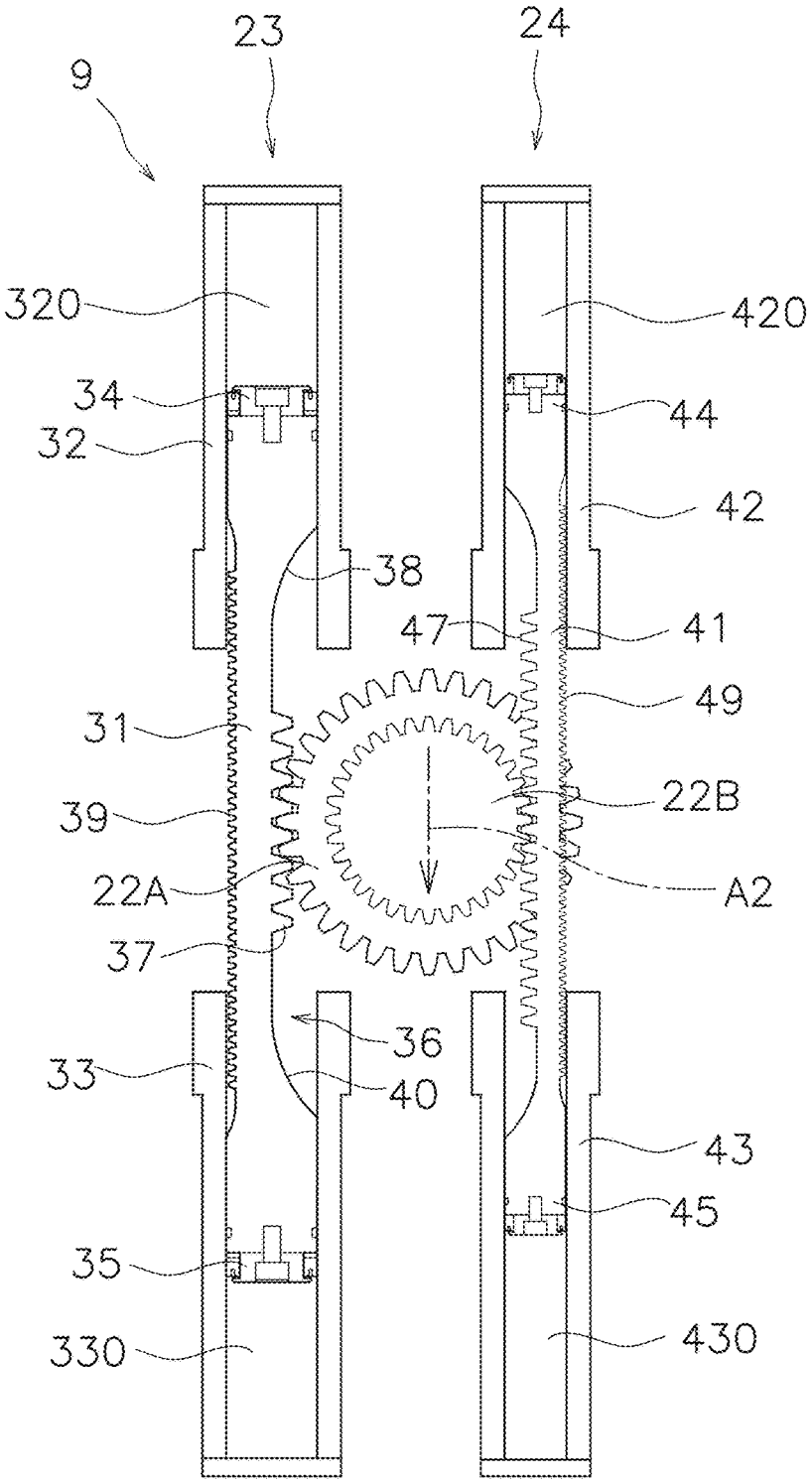
FIG. 4 is a top view showing an operation of a steering mechanism.

As shown in FIG. 4, the first cylinder 23 includes a first rack 31, a first cylinder tube 32, and a second cylinder tube 33. The first rack 31 extends in the front-rear direction. The first rack 31 is movable in the front-rear direction. The first rack 31 includes a first end 34 and a second end 35. The first end 34 is arranged in the first cylinder tube 32. The second end 35 is arranged in the second cylinder tube 33. The first cylinder tube 32 and the second cylinder tube 33 are spaced apart from each other in the front-rear direction. The first pinion gear 22A is arranged between the first cylinder tube 32 and the second cylinder tube 33 in the front-rear direction.

The first rack 31 linearly moves in the front-rear direction due to hydraulic pressure from the first hydraulic actuator 25. Specifically, the first cylinder tube 32 includes a first chamber 320. The second cylinder tube 33 includes a second chamber 330. The hydraulic fluid from the first hydraulic actuator 25 is supplied to the first chamber 320 so that the first rack 31 moves rearward due to the hydraulic pressure in the first chamber 320. The hydraulic fluid from the first hydraulic actuator 25 is supplied to the second chamber 330 so that the first rack 31 moves forward due to the hydraulic pressure in the second chamber 330.

The first rack 31 includes a first recess 36, a plurality of first teeth 37, a first relief portion 38, and a second relief portion 40. The first recess 36 is provided on the inner side surface of the first rack 31. The first recess 36 extends in the front-rear direction. The first recess 36 is located between the first end 34 and the second end 35. The first recess 36 faces the first pinion gear 22A. The plurality of first teeth 37 are provided in the first recess 36. The plurality of first teeth 37 are arranged side by side with each other in the front-rear direction. The first rack 31 moves forward and backward while the plurality of first teeth 37 are in mesh with the first pinion gear 22A so that the first pinion gear 22A rotates.

The first relief portion 38 and the second relief portion 40 are portions of the first recess 36 where the first teeth 37 are not provided. The first relief portion 38 is arranged in front of the plurality of first teeth 37. The second relief portion 40 is arranged behind the plurality of first teeth 37. The first relief portion 38 and the second relief portion 40 have shapes that avoid the first pinion gear 22A so as not to contact the first pinion gear 22A.

In a state where the first pinion gear 22A is arranged in the first relief portion 38, the first relief portion 38 does not contact the first pinion gear 22A. In a state where the first pinion gear 22A is arranged in the first relief portion 38, the plurality of first teeth 37 do not mesh with the first pinion gear 22A. Therefore, when the first pinion gear 22A is arranged in the first relief portion 38, the first pinion gear 22A is able to idle with respect to the first rack 31 without moving the first rack 31.

In a state where the first pinion gear 22A is arranged in the second relief portion 40, the second relief portion 40 does not contact the first pinion gear 22A. In a state where the first pinion gear 22A is arranged in the second relief portion 40, the plurality of first teeth 37 do not mesh with the first pinion gear 22A. Therefore, when the first pinion gear 22A is arranged in the second relief portion 40, the first pinion gear 22A is able to idle with respect to the first rack 31 without moving the first rack 31.

The second cylinder 24 has a structure substantially bilaterally symmetrical with the first cylinder 23. The second cylinder 24 includes a second rack 41, a third cylinder tube 42, and a fourth cylinder tube 43. The second rack 41 extends in the front-rear direction. The second rack 41 is movable in the front-rear direction. The second rack 41 includes a third end 44 and a fourth end 45. The third end 44 is arranged in the third cylinder tube 42. The fourth end 45 is arranged in the fourth cylinder tube 43. The third cylinder tube 42 and the fourth cylinder tube 43 are spaced apart from each other in the front-rear direction. The second pinion gear 22B is arranged between the third cylinder tube 42 and the fourth cylinder tube 43 in the front-rear direction.

The second rack 41 linearly moves in the front-rear direction due to hydraulic pressure from the second hydraulic actuator 26. Specifically, the third cylinder tube 42 includes a third chamber 420. The fourth cylinder tube 43 includes a fourth chamber 430. The hydraulic fluid from the second hydraulic actuator 26 is supplied to the third chamber 420 so that the second rack 41 moves rearward due to the hydraulic pressure in the third chamber 420. The hydraulic fluid from the second hydraulic actuator 26 is supplied to the fourth chamber 430 so that the second rack 41 moves forward due to the hydraulic pressure in the fourth chamber 430.

The length of the second rack 41 in the front-rear direction is smaller than the length of the first rack 31 in the front-rear direction. As shown in FIG. 2, the second rack 41 has a smaller axial cross-section than the first rack 31. The second rack 41 includes a plurality of second teeth 47. The plurality of second teeth 47 are arranged side by side with each other in the front-rear direction. The plurality of second teeth 47 have a smaller module than the plurality of first teeth 37. The second rack 41 moves forward and backward while the plurality of second teeth 47 are in mesh with the second pinion gear 22B so that the second pinion gear 22B rotates.

The first rack 31 includes a first detector 39. The first detector 39 is provided on the outer side surface of the first rack 31. The first detector 39 includes a plurality of teeth. The second rack 41 includes a second detector 49. The second detector 49 is provided on the outer side surface of the second rack 41. The second detector 49 includes a plurality of teeth.

As shown in FIG. 2, the outboard motor 1 includes a first rack sensor 14 and a second rack sensor 15. The first rack sensor 14 meshes with the plurality of teeth of the first detector 39 of the first rack 31. The first rack sensor 14 detects the position of the first rack 31. The second rack sensor 15 meshes with the plurality of teeth of the second detector 49 of the second rack 41. The second rack sensor 15 detects the position of the second rack 41.

FIG. 4 shows the steering mechanism 9 in a neutral state. In a case where the steering mechanism 9 is in the neutral state, the steering angle of the second housing 4 is 0 degrees. That is, in the neutral state, the second housing 4 and the propeller shaft 7 are parallel to the front-rear direction of the outboard motor 1. In FIGS. 3 to 8, the dashed line A2 indicates the direction of the second housing 4, that is, the direction of the propeller shaft 7. In a case where the steering mechanism 9 is in the neutral state, the first pinion gear 22A meshes with the first teeth 37 and the second pinion gear 22B meshes with the second teeth 47.

Figure 5:
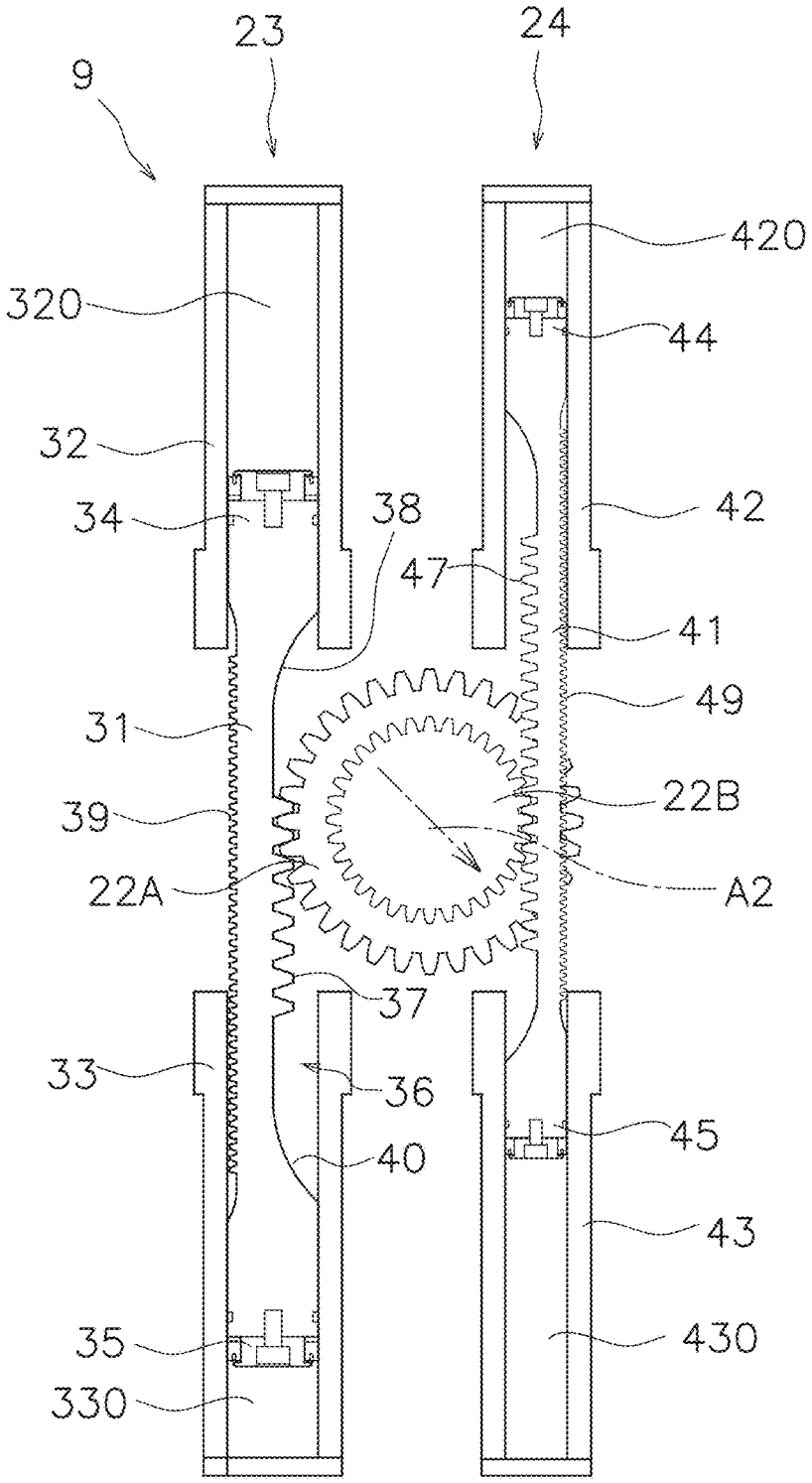
FIG. 5 is a top view showing the operation of the steering mechanism.

FIG. 5 shows the steering mechanism 9 in a first right steering state. As the first rack 31 moves rearward from the neutral state shown in FIG. 4, the steering mechanism 9 enters the first right steering state shown in FIG. 5. In a case where the rightward steering angle of the second housing is in a first range, the steering mechanism 9 is in the first right steering state. The first range is a range in which the steering angle is greater than 0 degrees and less than or equal to a predetermined angle threshold.

In a case where the steering mechanism 9 is in the first right steering state, the first teeth 37 mesh with the first pinion gear 22A and the second teeth 47 mesh with the second pinion gear 22B. In a case where the steering mechanism 9 is in the first right steering state, the second hydraulic actuator releases the hydraulic pressure to the second rack 41 to allow the second rack 41 to move in the front-rear direction. For example, by switching the hydraulic circuit from the second hydraulic actuator 26 to the second cylinder 24 by the second control valve 17, the hydraulic circuit pressure to the second rack 41 is released.

In the first right steering state, the first rack 31 moves rearward while the first teeth 37 mesh with the first pinion gear 22A. The first pinion gear 22A rotates as the first rack 31 moves. As a result, the second housing 4 is steered rightward, as indicated by the dashed arrow R1 in FIG. 3. The second pinion gear 22B rotates according to the rotation of the first pinion gear 22A so that the second rack 41 moves forward. However, since the hydraulic pressure to the second rack 41 is released and the second rack 41 is movable in the front-rear direction, the load on the second rack 41 is small.

Figure 6:
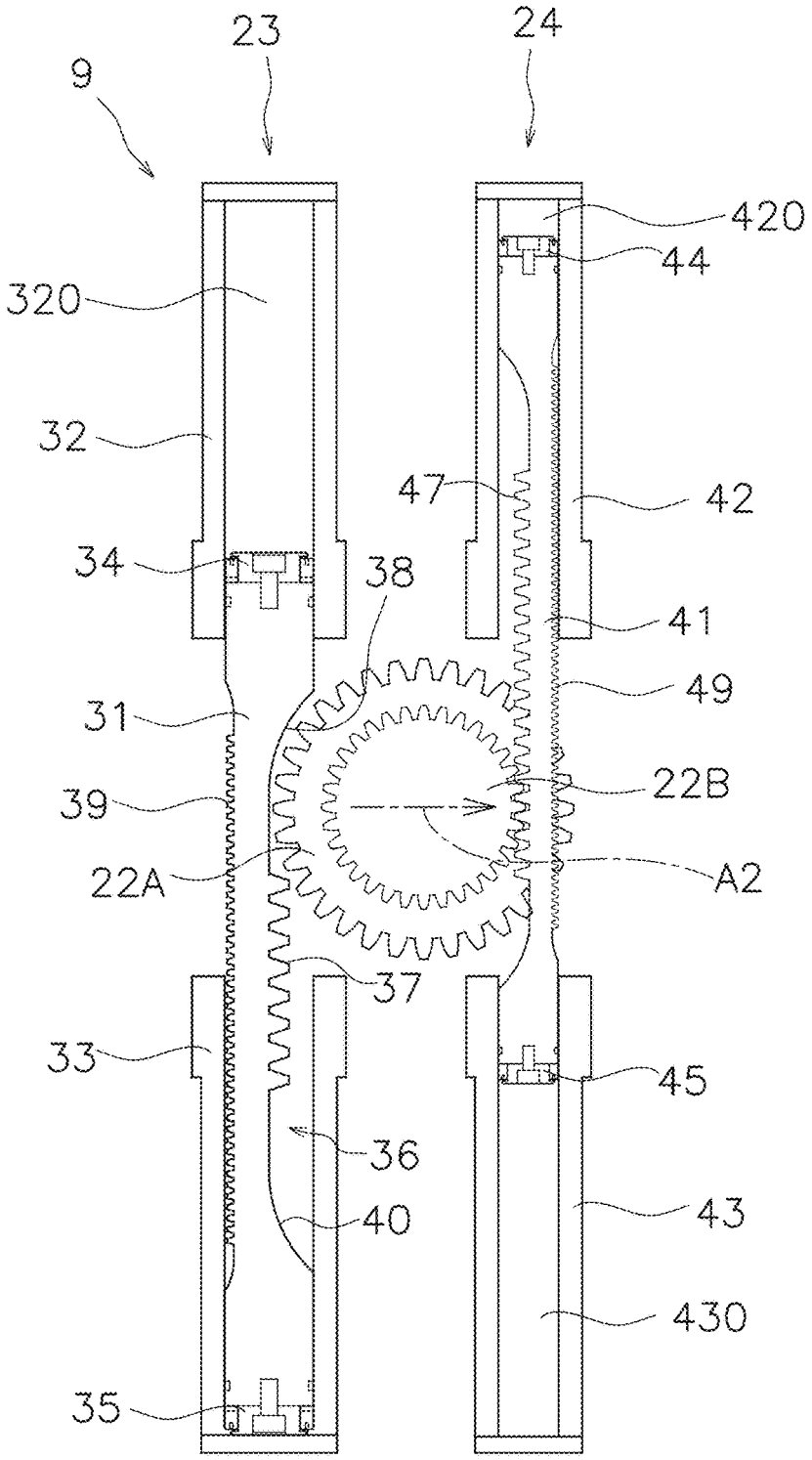
FIG. 6 is a top view showing the operation of the steering mechanism.

In a case where the rightward steering angle of the second housing is in a second range, the steering mechanism 9 is in the second right steering state. The steering angle of the second housing in the second range is greater than the steering angle of the second housing in the first range. The second range is a range that is larger than the angle threshold described above. FIG. 6 shows the steering mechanism 9 in the second right steering state.

In a case where the steering mechanism 9 is in the second right steering state, the second teeth 47 mesh with the second pinion gear 22B, and the first relief portion 38 faces the first pinion gear 22A. The second rack 41 is moved forward by hydraulic fluid from the second hydraulic actuator 26. Therefore, in the second right steering state, the second rack 41 moves forward while the plurality of second teeth 47 mesh with the second pinion gear 22B, and the first pinion gear 22A faces the first relief portion 38 and idles with respect to the first rack 31. Therefore, the first rack 31 does not move, and the first pinion gear 22A and the second pinion gear 22B rotate according to the movement of the second rack 41. Thus, the second housing 4 is steered farther to the right.

Figure 7:
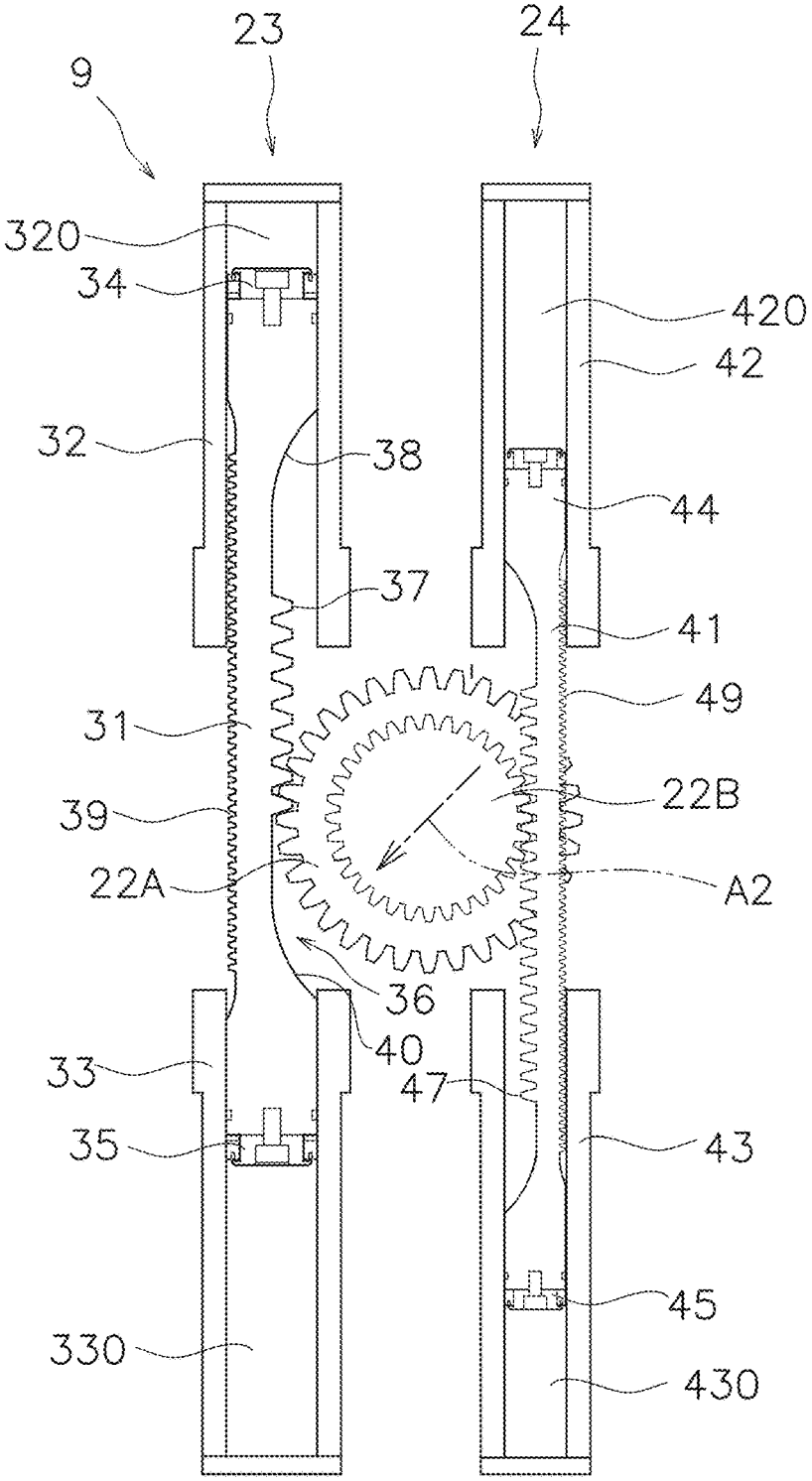
FIG. 7 is a top view showing the operation of the steering mechanism.

FIG. 7 shows the steering mechanism 9 in a first left steering state. As the first rack 31 moves forward from the neutral state shown in FIG. 4, the steering mechanism 9 enters the first left steering state shown in FIG. 7. In a case where the leftward steering angle of the second housing 4 is in the first range, the steering mechanism 9 is in the first left steering state.

In a case where the steering mechanism 9 is in the first left steering state, the first teeth 37 mesh with the first pinion gear 22A and the second teeth 47 mesh with the second pinion gear 22B. In a case where the steering mechanism 9 is in the first left steering state, the second hydraulic actuator 26 releases the hydraulic pressure to the second rack 41 to allow the second rack 41 to move in the front-rear direction.

In the first left steering state, the first rack 31 moves forward while the first teeth 37 mesh with the first pinion gear 22A. The first pinion gear 22A rotates as the first rack 31 moves. As a result, the second housing 4 is steered leftward as indicated by the dashed arrow L1 in FIG. 3. The second pinion gear 22B rotates according to the rotation of the first pinion gear 22A so that the second rack 41 moves rearward. However, since the hydraulic pressure to the second rack 41 is released and the second rack 41 is movable in the front-rear direction, the load on the second rack 41 is small.

Figure 8:
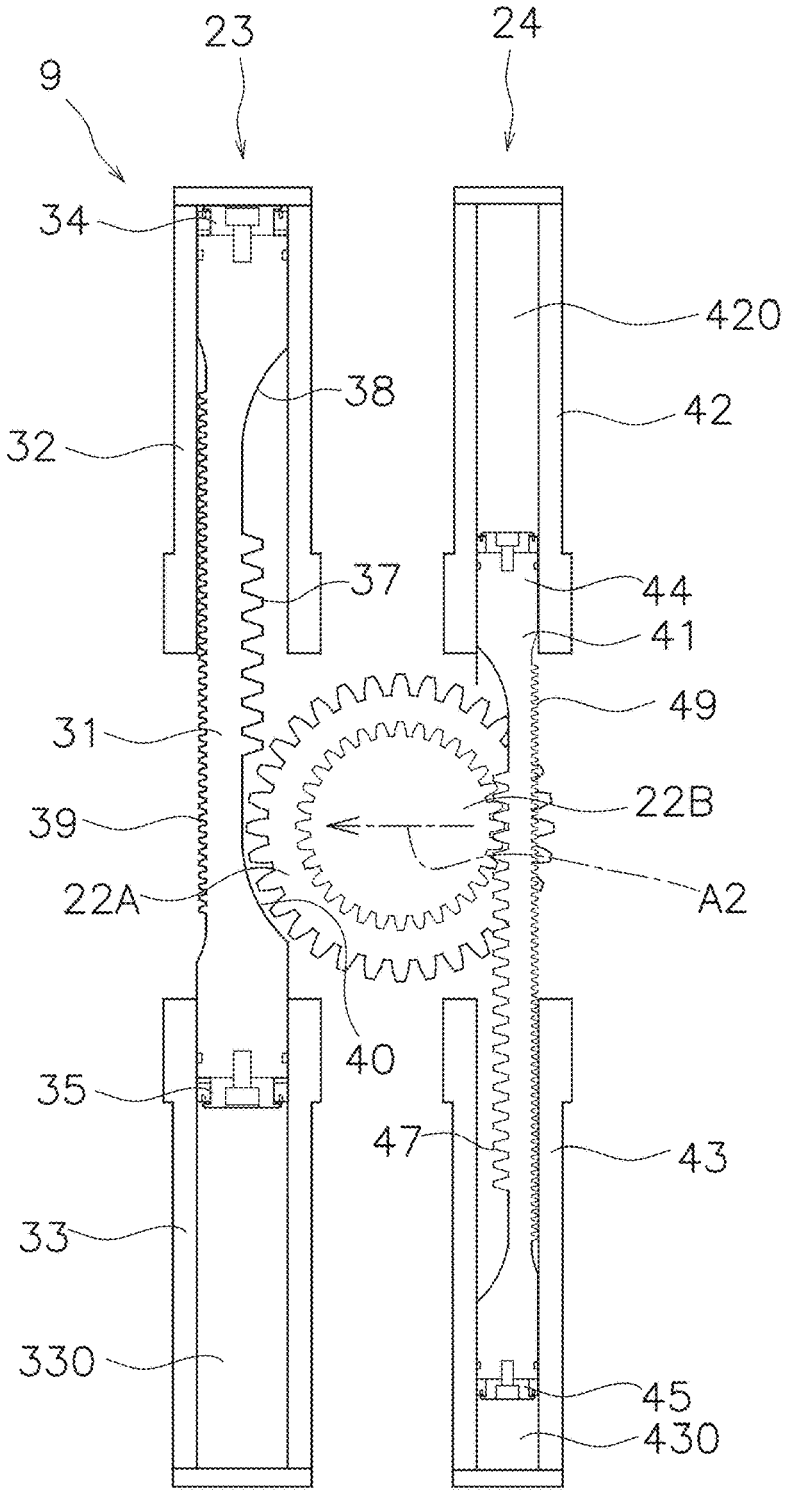
FIG. 8 is a top view showing the operation of the steering mechanism.

In a case where the leftward steering angle of the second housing 4 is in the second range, the steering mechanism 9 is in a second left steering state. FIG. 8 shows the steering mechanism 9 in the second left steering state. In a case where the steering mechanism 9 is in the second left steering state, the second teeth 47 mesh with the second pinion gear 22B, and the second relief portion 40 faces the first pinion gear 22A. The second rack 41 is moved rearward by hydraulic fluid from the second hydraulic actuator 26. Therefore, in the second left steering state, the second rack 41 moves rearward while the plurality of second teeth 47 mesh with the second pinion gear 22B, and the first pinion gear 22A faces the second relief portion 40 and idles with respect to the first rack 31. Therefore, the first rack 31 does not move, and the first pinion gear 22A and the second pinion gear 22B rotate according to the movement of the second rack 41. Thus, the second housing 4 is steered farther to the left.

In the outboard motor 1 described above, the first rack 31 moves while the first teeth 37 mesh with the first pinion gear 22A so that the first pinion gear 22A rotates and the second housing 4 is steered. Further, the second rack 41 moves while the second teeth 47 mesh with the second pinion gear 22B so that the second pinion gear 22B rotates and the second housing 4 is steered. The second teeth 47 have a smaller module than the first teeth 37. Therefore, the size of the second rack 41 is reduced. As a result, a large steering angle is obtained while reducing or preventing an increase in the size of the outboard motor 1.

In a case where the steering mechanism 9 is in the second right steering state or the second left steering state, the first pinion gear 22A idles in the first relief portion 38 or the second relief portion 40. Therefore, the second housing 4 is steered by rotating the first pinion gear 22A and the second pinion gear 22B according to the movement of the second rack 41 without moving the first rack 31. Therefore, even if the length of the first rack 31 is short, a large steering angle is obtained. As a result, a large steering angle is obtained while reducing or preventing an increase in the size of the outboard motor 1.

When the steering angle is small, the boat 100 often travels at high speed, and a large torque is applied to the steering mechanism 9 at that time. Therefore, the second housing 4 is steered by the first rack 31 having a large module in the first range where the steering angle is small and the steering mechanism 9 receives a large torque. On the other hand, when the steering angle is large, the boat 100 often travels at a low speed, and a small torque is applied to the steering mechanism 9 at that time. Therefore, the second housing 4 is steered by the second rack 41 having a small module in the second range where the steering angle is large and the steering mechanism 9 receives a small torque. As a result, the second housing 4 is steered appropriately according to the magnitude of the torque applied to the steering mechanism 9 while reducing or preventing an increase in the size of the outboard motor 1.

Although preferred embodiments of the present invention have been described above, the present invention is not limited to the above-described preferred embodiments and various modifications are possible without departing from the gist of the present invention.

The structures of the first cylinder 23 and the second cylinder 24 are not limited to those of the above-described preferred embodiments, and may be modified. The first pinion gear 22A and the second pinion gear 22B may be connected to the first housing 3 instead of the second housing 4. In that case, the first cylinder 23 and the second cylinder 24 may be supported by the second housing 4. The first rack 31 and the second rack 41 may be driven by hydraulic motors. Alternatively, the first rack 31 and the second rack 41 may be driven by electric actuators such as electric motors.

The first rack 31 and/or the second rack 41 may extend not only in the front-rear direction of the outboard motor 1 but also in other directions. That is, the first direction, which is the moving direction of the first rack 31, is not limited to the front-rear direction of the outboard motor 1, and may be other directions such as the left-right direction. The second direction, which is the moving direction of the second rack 41, is not limited to the front-rear direction of the outboard motor 1, and may be other directions such as the left-right direction. In the above-described preferred embodiments, the number of racks to rotate the first pinion gear 22A and the second pinion gear 22B is two. However, the number of racks may be greater than two.

Figure 9:
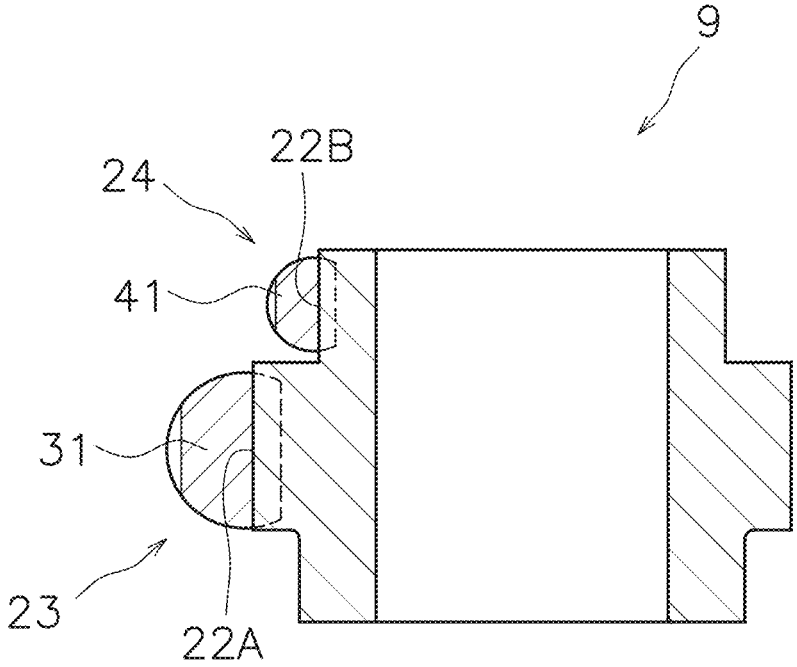
FIG. 9 is a cross-sectional view of a portion of the steering mechanism according to a modification of a preferred embodiment of the present invention.

The arrangement of the second rack 41 is not limited to that of the above-described preferred embodiments, and may be changed. For example, FIG. 9 is a cross-sectional view of a portion of the steering mechanism 9 according to a modification of a preferred embodiment of the present invention. As shown in FIG. 9, the second rack 41 may be arranged side by side with the first rack 31 in the vertical direction.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:
- a first housing;
- a second housing supported by the first housing and steerable around a steering axis;
- a propeller shaft in the second housing and extending in a front-rear direction of the outboard motor; and
- a steering mechanism to steer the second housing around the steering axis, the steering mechanism including:
  - a first pinion gear connected to the first housing or the second housing;
  - a second pinion gear connected to the first pinion gear;
  - a first rack including a plurality of first teeth that mesh with the first pinion gear and arranged side by side with each other in a first direction, the first rack being movable in the first direction; and
  - a second rack including a plurality of second teeth that mesh with the second pinion gear, arranged side by side with each other in a second direction, and have a smaller module than the plurality of first teeth, the second rack being movable in the second direction.

2. The outboard motor according to claim 1, wherein a length of the second rack in the second direction is smaller than a length of the first rack in the first direction.

3. The outboard motor according to claim 1, wherein in a case where a steering angle of the second housing is in a first range, the first rack is movable in the first direction to rotate the first pinion gear and steer the second housing; and in a case where the steering angle of the second housing is in a second range that is larger than the first range, the second rack is movable in the second direction to rotate the second pinion gear and steer the second housing.

4. The outboard motor according to claim 3, wherein the first rack includes a first relief portion; and in a case where the steering angle of the second housing is in the second range, the first relief portion faces the first pinion gear to allow the first pinion gear to idle with respect to the first rack.

5. The outboard motor according to claim 1, further comprising a first hydraulic actuator to move the first rack in the first direction.

6. The outboard motor according to claim 1, further comprising a second hydraulic actuator to move the second rack in the second direction.

7. The outboard motor according to claim 6, wherein in a case where the steering angle of the second housing is in a first range, the first rack is movable in the first direction to rotate the first pinion gear and steer the second housing;

in a case where the steering angle of the second housing is in a second range that is larger than the first range, the second rack is movable in the second direction to rotate the second pinion gear and steer the second housing; and in a case where the steering angle of the second housing is in the first range, the second hydraulic actuator is operable to release hydraulic pressure to the second rack to allow the second rack to move in the second direction.

8. The outboard motor according to claim 1, wherein the first direction is the front-rear direction of the outboard motor.

9. The outboard motor according to claim 1, wherein the second direction is the front-rear direction of the outboard motor.

* * * * *